US006676272B2

(12) United States Patent
Chance

(10) Patent No.: US 6,676,272 B2
(45) Date of Patent: Jan. 13, 2004

(54) INTERACTIVE MIRROR SYSTEM FOR OVERNIGHT LODGING ESTABLISHMENT

(76) Inventor: C. Richard Chance, 6615 N. 65th St., Paradise Valley, AZ (US) 85253

( * ) Notice: Subject to any disclaimer, the term of this patent is extended or adjusted under 35 U.S.C. 154(b) by 166 days.

(21) Appl. No.: 09/895,296

(22) Filed: Jun. 29, 2001

(65) Prior Publication Data

US 2003/0002278 A1 Jan. 2, 2003

(51) Int. Cl.[7] ..... A47B 23/06; A47B 97/00; F21V 33/00

(52) U.S. Cl. ..... 362/128; 362/135; 362/140; 362/800; 340/691.1

(58) Field of Search ..... 362/128, 125, 362/251, 135, 140, 494, 800, 147, 276, 802; 340/691.1, 691.6, 525, 5.91, 286.06; 40/544

(56) References Cited

U.S. PATENT DOCUMENTS 5,053,868 A * 10/1991 Higgins et al. ..... 358/93
5,124,845 A * 6/1992 Shimojo ..... 359/838
6,172,613 B1 * 1/2001 DeLine et al. ..... 340/815.4
6,420,975 B1 * 7/2002 DeLine et al. ..... 340/815.4

OTHER PUBLICATIONS

Meine (U.S. Publication 2002/0080494A1), Mirror information panel, Jun. 27, 2002.*

* cited by examiner

*Primary Examiner*—Stephen Husar
*Assistant Examiner*—Sharon Payne
(74) *Attorney, Agent, or Firm*—Tod R. Nissle, P.C.

(57) ABSTRACT

An interactive mirror for a motel or hotel automatically communicates with an individual staying in a room when the light in the room in which the mirror is mounted is turned on. The interactive mirror places the individual with room service, can be deactivated by the individual, permits light from a source positioned behind the mirror to be visible to the individual when the individual stands in front of the mirror, and permits audio and visual communication with the individual.

1 Claim, 2 Drawing Sheets

INTERACTIVE MIRROR SYSTEM FOR OVERNIGHT LODGING ESTABLISHMENT

More particularly, the invention relates to an interactive mirror system for an overnight lodging establishment.

In a further respect, the invention relates to an interactive mirror system for a motel or hotel which automatically communicates with an individual staying in a room when the light in the room in which the mirror is mounted is turned on, which places the individual in contact with room service or other services, which can be deactivated by the individual, which permits light from a source positioned behind the mirror to be visible to the individual when the individual stands in front of the mirror, and which permits audio and visual communication with the individual.

A variety of systems are known for communicating with an individual staying overnight in the Holiday Inn (SM), Hilton (SM), Sheraton (SM) or other overnight lodging establishment. The front desk of the hotel/motel can leave a message accessible via the telephone in the room. Messages can be imprinted on paper slips or forms which are slid under the door to the room. Placards can be left in the room. One important objective of such methods of communication is to insure that the individual(s) staying in the room actually reads or listens to the communication. Another objective is to require only a minimal effort on the part of the individual to read or listen to the communication. It usually is more likely that an individual will look at a communication if only a minimal amount of time and effort is required. Another objective of such communications is to make them look interesting or inviting so the individual will want to read or listen to the communication. While conventional means of communicating with an individual in a hotel room have had success, it would be highly desirable to provide an improved method of communicating which would better insure that an individual staying in the room actually read or listened to the communication, which would require minimal effort on the part of the individual, and which would look or sound interesting.

Therefore, it is a principal object of the instant invention to provide an improved method and apparatus for communicating with an individual who is staying in a room in a hotel or motel.

A further object of the invention is to provide an improved method and apparatus which automatically communicates with an individual when an individual enters the room.

Another object of the invention is to provide an improved communication method and apparatus which enables an individual to groom himself or herself while simultaneously communicating with the staff at an overnight lodging establishment.

Figure 1:
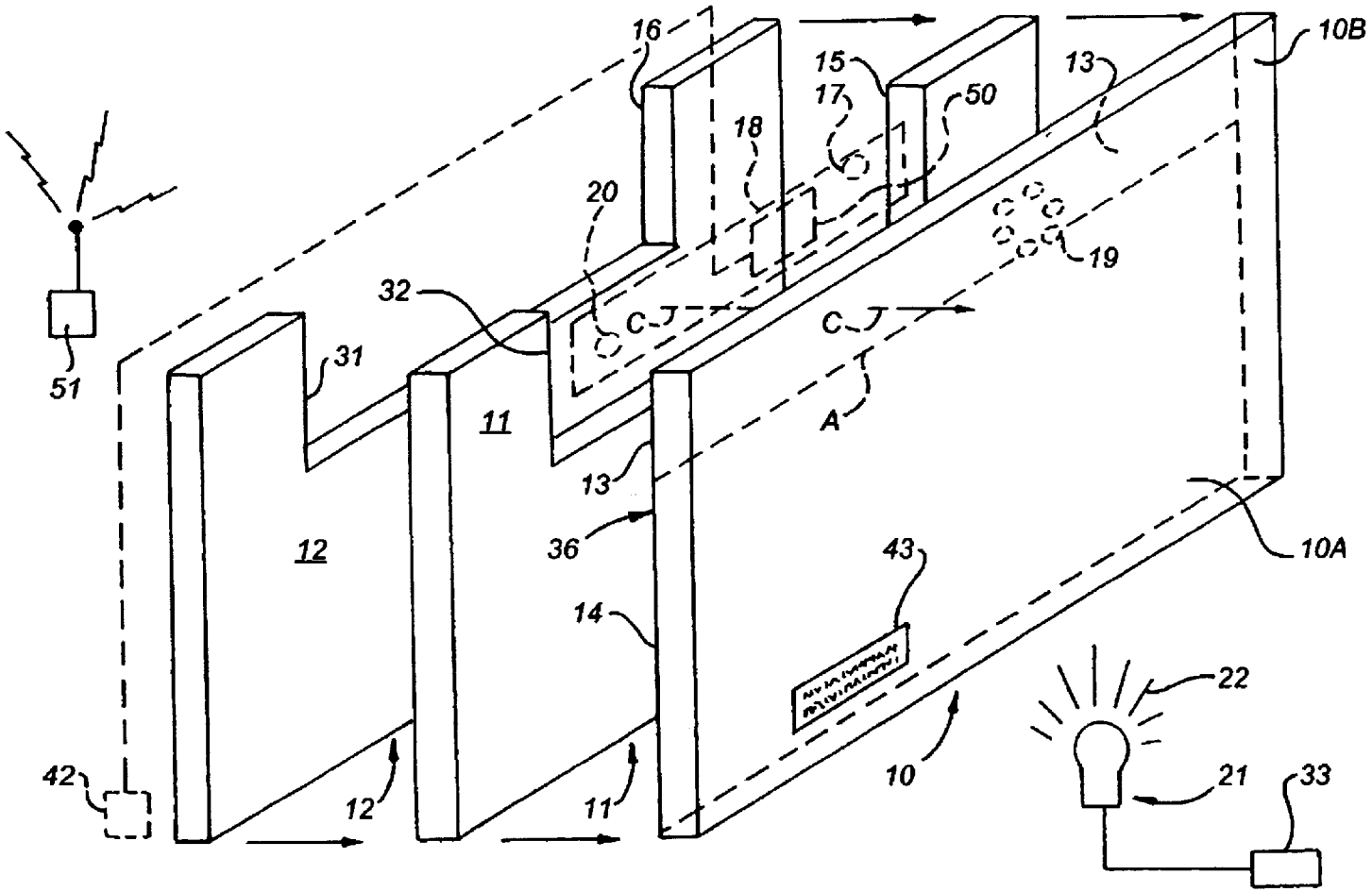
Figure 2:
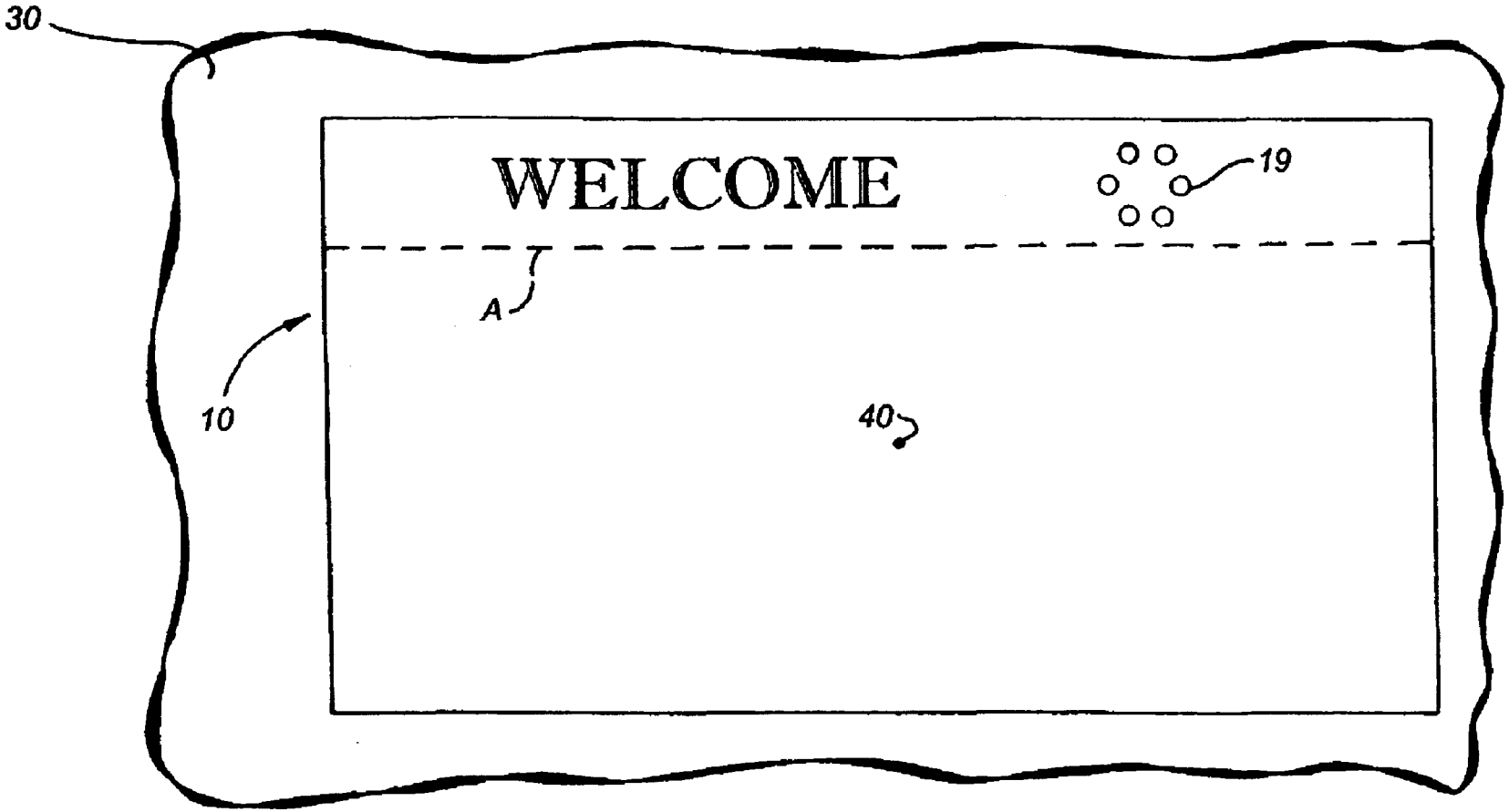

These, and other and further and more specific objects of the invention will be apparent to those skilled in the art based on the following description, taken in conjunction with the drawings, in which:

FIG. 1 is an exploded view of a laminate mirror construction in accordance with the principles of the invention; and, FIG. 2 is a front view of the mirror construction of FIG. 1 mounted on a vertical wall in the room of an overnight lodging establishment.

Briefly, in accordance with the invention, I provide improvements in combination with a room in an overnight lodging establishment. The room includes at least one wall. The improvements interact with an individual staying in the room. The improvements comprise an interactive mirror system mounted on the wall. The mirror system includes a vertically oriented glass panel including an upper portion and a lower portion and a front and a back; a layer of material on the back of the lower portion such that the lower portion functions as a mirror; apparatus mounted behind the glass panel to produce alphanumeric symbols that emit light that passes through the back and the front of the glass panel and are viewable by an individual standing in front of the interactive mirror system.

In another embodiment of the invention, I provide improvements in combination with a room in an overnight lodging establishment. The room includes at least one wall, a light, and a control switch to turn the light on and off. The improvements interact with an individual staying in the room. The improvements comprise an interactive mirror system mounted on the wall. The mirror system includes a vertically oriented glass panel including an upper portion and a lower portion and a front and a back; a layer of material on the back of the lower portion such that the lower portion functions as a mirror; a sensor mounted on the interactive mirror system to detect when the control switch turns the light on and to produce a message for the individual staying in the room.

In a further embodiment of the invention, I provide improvements in combination with a room in an overnight lodging establishment. The room includes at least one wall, a light, and a control switch to turn the light on and off. The improvements interact with an individual staying in the room. The improvements comprise an interactive mirror system mounted on the wall. The improvements include a vertically oriented glass panel including an upper portion and a lower portion and a front and a back; a layer of material on the back of the lower portion such that the lower portion functions as a mirror; a receiver/speaker mounted behind the glass panel to audibly communicate with the individual staying in the room.

In still another embodiment of the invention, I provide improvements in combination with a room in an overnight lodging establishment. The room includes at least one wall, a light, and a control switch to turn the light on and off. The improvements interact with an individual staying in the room. The improvements comprise an interactive mirror system mounted on the wall. The improvements include a vertically oriented glass panel including an upper portion and a lower portion and a front and a back; a layer of material on the back of the lower portion such that the lower portion functions as a mirror; a communication system mounted behind the glass panel to communicate with the individual staying in the room; and, a control system operable by the individual staying in the room to deactivate the communication means.

In yet a further embodiment of the invention, I provide improvements in combination with a room in an overnight lodging establishment. The room includes at least one wall, a light, and a control switch to turn the light on and off. The improvements interact with an individual staying in the room. The improvements comprise an interactive mirror system mounted on the wall. The mirror system includes a vertically oriented glass panel including an upper portion and a lower portion and a front and a back; a layer of material on the back of the lower portion such that the lower portion functions as a mirror; a communication system mounted behind the glass panel to communicate with the individual staying in the room; and, apparatus to inform the individual staying in the room that the interactive mirror system does not include video means for viewing the activities of the individual in the room.

Turning now to the drawings, which describe the presently preferred embodiments of the invention for the purpose of describing the operation and use thereof and not by way of limitation of the scope of the invention, and in which like reference characters refer to corresponding elements throughout the several views, FIG. 1 is an exploded view illustrating a laminate mirror construction including rectangular piece 10 of clear glass. As used herein, the term "glass" includes borosilicates and other clear glasses and also includes polymer and other compositions which produce a clear transparent material. Piece 10 includes a front rectangular surface 35 and a rear rectangular surface 36. Piece 10 also includes an upper portion 10B and a lower portion 10A. The back surface 14 (below dashed line A) of lower portion 10A is coated with silver or another functionally comparable material which enables lower portion 10A to function as a mirror. The back surface 13 (above dashed line A) of upper portion 10B is coated with a material which prevents an individual standing in front of piece 10 to see LEDs and other apparatus mounted in U-shaped groove 32 behind piece 10, but which permits light from LEDs or other light sources to travel through the material coating surface 13, through back surface 36 of upper portion 10B, and through upper portion 10B to be viewed by a person standing in front of piece 10. The thickness of piece 10 can vary as desired but is presently preferably about one-quarter of an inch.

Rectangular piece 11 can be fabricated from any desired material, but is presently fabricated from a polyvinyl material to reduce the likelihood that piece 10 will break or shatter. Piece 11 is secured to back 36 with adhesive or any other desired fastening means. U-shaped groove 32 is cut in piece 11 such that LED's, a microprocessor, a speaker/receiver 17, television screen, light sensor 20, and/or other desired electronics and equipment can be mounted in the space 18 behind upper portion 10B and/or lower portion 10A. The thickness of piece 11 can vary as desired, but piece 11 is presently about five-sixteenths of an inch thick.

Although not necessary, an additional piece 12 of material can be fastened to piece 11 and may also include a U-shaped opening 31 to facilitate the positioning of LEDs, speakers, etc. behind upper portion 10B and/or lower portion 10A.

Openings 19 are formed through piece 10 to facilitate the broadcast of sound by speaker/receiver 17 and to facilitate the pickup by receiver 17 of the voice of an individual standing in front of the interactive mirror system of FIG. 1.

After piece 11 is adhered to piece 10, piece 11 is adhered or fastened to a vertical wall 30 in a room in an overnight lodging establishment. As used herein, overnight lodging establishments refer to hotels and motels and resorts and other establishments where individuals normally stay for one night or for relatively short periods of time of up to several weeks while traveling, vacationing, or on business. Overnight lodging establishments normally do not comprise the permanent residence of an individual. Best Western (SM), Hotel 6 (SM), Hilton (SM), Holiday Inn (SM), and Travel Lodge (SM) are well known examples of such establishments. The mirror system of FIG. 1 is typically, although not necessarily, mounted on a wall 30 such that when an individual of average height is standing in front of the mirror system, the individual's eye level is about at the center 40 of the mirror system.

Each room in an overnight lodging establishment ordinarily includes at least one light 21 and a wall switch or other control 33 for turning the light on and off.

In operation, the mirror system of FIG. 1 is installed in a room in the MIRAGE, an overnight lodging establishment. For purposes of this example, it is assumed that the mirror system is installed on a vertical wall in the bathroom of the room. When the individual checks into his room, it is 2:00 p.m. The individual walks into the bathroom and uses the wall switch 33 in the bathroom to turn on light 21 and illuminate the bathroom with light 22. Sensor 20 detects light 20 and generates a signal to a microprocessor 50 mounted in area 18. The microprocessor 50 causes the following audible message to be broadcast from receiver/speaker 17 through apertures 19 to the individual: "Good afternoon. Thank you for choosing the MIRAGE." The microprocessor 50 also activates LEDs mounted in area 18 so that "WELCOME" appears in the manner illustrated in FIG. 2.

The microprocessor 50 then causes the LEDs to display the message: "Would you like room service? Please answer yes or no." If desired, the microprocessor 50 can also broadcast this question over receiver/speaker 17. If the individual answers "No.", this is picked up by receiver/speaker 17 and processed by voice recognition software in the microprocessor 50. The microprocessor 50 causes "Thank you." to be broadcast over receiver/speaker 17. If the individual answers "Yes.", this answer is pickup up by receiver/speaker 17 and is processed by voice recognition software in the microprocessor 50. The microprocessor 50 causes room service to be called. An individual in room service answers and his or her voice response "This is room service. May we have your room number please?" is broadcast over receiver/speaker 17. In the alternative, room service can call the individual on the telephone in the individual's room. The individual then orders by conversing with room service via receiver/speaker 17.

The microprocessor 50 can be connected to room service, to the front desk of the hotel, to the valet service, etc. by hard wire, by fiber optic line, by a transmitter, or by any other desired communication apparatus. In one embodiment of the invention, a receiver/transmitter 51 is placed on each floor of a hotel to receive by wire signal, by fiber optic signal, by wireless signal, etc. the signals that are generated by the microprocessor 50. The microprocessor 50 includes receiver/transmitter apparatus for communicating with the receiver/transmitter 51. After the receiver/transmitter 51 receives a signal from the microprocessor 50, the signal is transmitted by the receiver/transmitter 51 to the front desk, to room service, etc. The receiver/transmitter 51 also receives signals from the front desk, room service, etc. and transmits the signals to the microprocessor 50.

The individual staying in the room can use switch 42 to disable or turn off the mirror system of FIGS. 1 and 2 so that the mirror system will not communicate audibly or visually with the individual.

A sticker 43 on piece 10 states: "This mirror system does NOT include a camera. Your activities in your room are PRIVATE and are NOT monitored by the hotel. Monitoring of your activities is FORBIDDEN by FEDERAL and STATE statutes."

A television screen can be placed in area 18 to display conventional television programs, to run advertisements, or to display any other desired information. Light from the television screen passes through section 10B and can be viewed by an individual standing in front of the mirror system.

In FIG. 2, the "WELCOME" can be displayed as a rolling script which moves from left to right. Other messages or advertisements can also be displayed in rolling script or displayed one word at a time without rolling or moving from side-to-side across an LED matrix or other light display.

Having described my invention in such terms as to be understood by those of skill in the art, and having described the presently preferred embodiments thereof, I claim:

1. In combination with a room in an overnight lodging establishment, the room including at least one wall, a light, and control means to turn the light on and off, the improvements for interacting with an individual staying in the room, said improvements comprising an interactive mirror system mounted on the wall and including (a) a vertically oriented glass panel including an upper portion and a lower portion and a front and a back;

(b) a layer of material on the back of the lower portion such that the lower portion functions as a mirror;

(c) sensor means mounted on the interactive mirror system to detect when the control means turns the light on and to produce a message for the individual staying in the room.

* * * * *